US008740926B2

(12) United States Patent
Blomdahl et al.

(10) Patent No.: US 8,740,926 B2
(45) Date of Patent: Jun. 3, 2014

(54) SYSTEM AND METHOD FOR PIERCING AND POSITIONING BODY OR EAR JEWELLERY

(75) Inventors: Karl Blomdahl, Halmstad (SE); Lars Blomdahl, Haverdal (SE)

(73) Assignee: Blomdahl Medical Aktiebolag, Halmstad (SE)

( * ) Notice: Subject to any disclaimer, the term of this patent is extended or adjusted under 35 U.S.C. 154(b) by 1295 days.

(21) Appl. No.: 12/095,290

(22) PCT Filed: Nov. 28, 2006

(86) PCT No.: PCT/SE2006/001351
§ 371 (c)(1),
(2), (4) Date: May 28, 2008

(87) PCT Pub. No.: WO2007/061366
PCT Pub. Date: May 31, 2007

(65) Prior Publication Data

US 2008/0294185 A1 Nov. 27, 2008

(30) Foreign Application Priority Data

Nov. 28, 2005 (SE) ..... 0502603

(51) Int. Cl.
*A61B 17/34* (2006.01)

(52) U.S. Cl.
USPC ..... 606/188

(58) Field of Classification Search
USPC ..... 606/117, 167, 181, 184–189
See application file for complete search history.

(56) References Cited

U.S. PATENT DOCUMENTS

| | | | | |
|---|---|---|---|---|
| 3,500,829 | A | 3/1970 | Abramowitz | |
| 3,941,134 | A | 3/1976 | McDonald | |
| 4,079,740 | A | 3/1978 | Phalon | |
| 4,164,224 | A * | 8/1979 | Hastings | 606/185 |
| 5,004,471 | A | 4/1991 | Mann | |
| 5,350,394 | A | 9/1994 | Mann | |
| 5,709,700 | A | 1/1998 | Hirota | |
| 5,792,170 | A | 8/1998 | Reil | |
| 6,053,931 | A | 4/2000 | Lizcano | |
| 6,183,490 | B1 | 2/2001 | Korbar et al. | |
| 2002/0084207 | A1 * | 7/2002 | Mann | 206/581 |

FOREIGN PATENT DOCUMENTS

| | | |
|---|---|---|
| DE | 3935969 C1 | 9/1990 |
| DE | 19816841 A1 | 10/1999 |
| EP | 0559637 | 9/1993 |
| GB | 1247653 | 3/1970 |
| GB | 2310378 A | 6/1997 |

* cited by examiner

*Primary Examiner* — Ryan Severson
*Assistant Examiner* — Katherine M Shi
(74) *Attorney, Agent, or Firm* — Volpe and Koenig, P.C.

(57) ABSTRACT

A system (1) for piercing and positioning a piece of body jewelry or ear jewelry (100) in a skin portion is provided. The system includes a pinching and sighting device having first and second gripping members (10*a*, 10*b*) which are adapted to grip a skin portion between them. The gripping members (10*a*, 10*b*) include an aiming member (11) to allow alignment of the pinching and sighting device relative to at least the position of the desired entry hole for piercing. Furthermore the pinching and sighting device includes a portion (12*a*) for arranging and aligning a cartridge (3). The cartridge has a pressing member (31) which is adapted to press at least one piercing member (101) arranged in the cartridge out of an opening (26) formed in the cartridge. A system and a method of preparation before piercing and positioning a piece of body jewelry or ear jewelry are also provided.

26 Claims, 10 Drawing Sheets

SYSTEM AND METHOD FOR PIERCING AND POSITIONING BODY OR EAR JEWELLERY

CROSS-REFERENCES AND RELATED APPLICATIONS

This application claims priority to Sweden patent application No. 0502603-4filed in Sweden on Nov. 28, 2005, the disclosure of which is expressly incorporated herein by reference in its entirety for any purpose.

FIELD OF THE INVENTION

The present invention relates to a system with integrated asepsis for piercing and positioning a piece of body jewelry or a piece of ear jewelry in a skin portion. The invention also concerns a cartridge, a pinching and sighting device as well as a catching device for use in said system. Moreover the invention concerns an aseptic method of preparation before piercing and positioning a piece of body jewelry or a piece of ear jewelry.

BACKGROUND ART

Piercing of body parts and skin portions thereof takes place frequently and occurs either manually or by means of some kind of instrument. The best known and most used instruments are specially adapted to piercing of ear lobes and can be divided into hand-operated and spring-operated instruments. An example of the former is given is U.S. Pat. No. 5,792,170 and an example of the latter is given in EP 0 559 637.

In all surgical operations, including piercing and positioning pieces of jewelry in body parts, it is desirable to use products and methods which enable and facilitate aseptic handling. By asepsis is meant a process and technique which aim at preventing spreading of pathogenic microorganisms. Since piercing of body parts for insertion of pieces of body jewelry or ear jewelry is often performed by non-medically trained staff, products and methods with integrated asepsis, to prevent infection and spreading of infectious matter, are extremely important.

In some prior art instruments for ear piercing, loose sterile pieces of ear jewelry are used for piercing with associated locking means, often packed in pairs. From an aseptic point of view it is, however, preferred to have a sterile disposable cartridge comprising a piece of ear jewelry and an associated locking means, where only the sterile disposable cartridge will come close to the skin and the hole that is to be made, the cartridge being replaced with a new one after each individual piercing, and where before, during or after piercing the operator will not come into contact with or close to the piece of ear jewelry, locking means or the parts of the disposable cartridge that risk to be contaminated or may have been contaminated. Such a sterile disposable cartridge with an associated instrument is disclosed in EP 0 559 637. The construction and method described in EP 0 559 637 have the asepsis integrated in the system, but is mainly suited for ear piercing.

The prior art instruments for piercing ear lobes are, due to their construction, less suited or not suited at all for use on other body parts. Now follows an account of a number of reasons why existing products and methods for ear piercing are mainly suited for use in piercing of the ear and nothing else.

When piercing many other body parts, for example a navel, an operator grasps an originally substantially plane skin portion instead of a well-defined flap-like area such as an ear lobe. When piercing an ear lobe, basically only a desired entry hole therefore has to be determined, marked and aimed at, whereas in piercing other body parts, for instance a navel, both the desired entry hole and the desired exit hole have to be determined, marked and aimed at. When piercing an ear lobe with an instrument developed for this purpose, an entry hole is marked, after which the skin is disinfected. After that the operator takes aim at the mark using the tip of the piercing means, which with current technology is a sharp bar which is fixedly secured to the piece of ear jewelry or a cannula which is releasably connected to the piece of ear jewelry, after which the instrument is operated to press out the piercing means. By holding the instrument in a certain direction, the direction of the piercing means through the ear lobe is determined, and thus also the approximate location of the exit hole is obtained.

In manually piercing another body part, for instance a navel, both the desired entry hole and the desired exit hole are marked. After disinfection of the skin portion, a pair of tongs with gripping loops is used to squeeze the skin so that the entry and exit holes become visible in both loops of the pair of tongs. Then the operator must, by eye, aim the piercing means, which with current technology is a cannula separated from the piece of body jewelry or releasably connected thereto, or alternatively a sharp bar end of the actual piece of body jewelry, at the mark of the entry hole and, by eye, align the piercing means so that, when penetrating the skin portion, it will exit just in the mark made for the exit hole.

Another aspect which differs when piercing an ear lobe compared with piercing certain other body parts, for instance a navel, is the appearance of the piece of body jewelry which is preferred. When piercing an ear lobe, a piece of ear jewelry with a completely straight bar is generally preferred. This means that the motion that is required for positioning the piece of ear jewelry is completely linear. When piercing other body parts where the hole is done by pinching an originally substantially plane skin portion, for instance adjacent to a navel, a piece of body jewelry with a bent bar is preferred. The purely medical reason for this is that when piercing an originally substantially plane skin portion, a piece of body jewelry with a straight bar would cause more tension in the pierced body portion since the locking means and decorative member of such a piece of jewelry abut against the plane skin and act to press out the bar from the plane skin surface. On a short view, the risk of irritation and infection increases while in a somewhat longer view the risk increases that such a straight piece of jewelry is rejected and migrates out of the user's body. Purely cosmetically, the advantage is that in certain body parts, for instance a navel, a piece of body jewelry with a bent bar has a more attractive appearance. The design of the bar of the piece of body jewelry affects the requirements placed on the piercing process since insertion of a piece of body jewelry with a straight bar can take place by fully linear motions, whereas the insertion of a piece of body jewelry with a bent bar must take place by a non-linear motion.

The instruments and the sterile disposable products for piercing ear lobes which allow and simplify the use of asepsis are for, inter alia, the above reasons not suitable for use when piercing other body parts than precisely ears. Piercing of body parts and skin portions except ears often takes place using purely manually aids by the skin in the area in which piercing is to take place, for example a navel or an eye brow, being disinfected and squeezed by a squeezing means in the form of a pair of tongs with loops. Subsequently piercing takes place by the operator holding a piercing means in the form of a cannula directly with his fingers and manually pressing this through the skin portion through a marked desired entry hole and a marked desired exit hole respectively. In conjunction with pulling out of the cannula from the penetrated skin portion, or just after that, the piece of body jewelry is held directly with the operator's fingers, after which the bar of the piece of body jewelry is manually pressed through the resulting hole. It also happens that the cannula is mounted directly on the bar, whereby this is put in place while the cannula is being pressed through the skin portion, see for example U.S. Pat. No. 3,500,829.

To fasten the piece of body jewelry in the skin, a locking means is mounted on the free end of the bar. The locking means is usually mounted manually. For body jewelry, this usually takes place by a locking means in the form of a ball being held with the fingers and threaded onto the free end of the bar, which requires some dexterity of the operator since the locking means itself is small and has a fine internal thread. The mounting of the locking means also results in an inevitable contact with the skin portion around the piercing just made.

A common feature of these manual piercing methods is that they involve blood, that is the handling is such that it is practically impossible to prevent blood from being visible and exposed, which thus results in a serious risk of infection to the operator and discomfort to the individual who is being pierced. Another common feature is that these manual methods also comprise the step that the operator has to handle a sharp piercing means with his fingers, which, together with the exposure of blood, creates a serious risk of infection to the patient as well as to the operator. A further common feature is that the operator with his fingers comes into contact with the piece of body jewelry and/or its locking means, which thus constitutes another risk of infection. These risks of infection, of course, involve microorganisms which may cause serious wound infections, but the risks of infection also apply to deadly blood virus, such as HIV and hepatitis.

Summing up, the manual piercing methods pose great risks of spreading infectious matter and infection. It is true that with the above described products and methods it is possible to work aseptically, which, however, requires knowledge, experience, accuracy and staff resources.

Instruments are available, which are used to pinch the skin and then make the piercing means penetrate the skin, for instance those disclosed in GB 2 310 378 A and DE 198 16 841 A1. Also these instruments suffer from many of the drawbacks from the aseptic point of view as mentioned above.

A specific problem in piercing performed with a piercing means in the form of a loose sharp unit or with a sharp unit, such as a cannula, which is releasably connected to the bar of the piece of body jewelry, is that the handling of the piercing means used can pose a certain risk above all to the operator. However, there are solutions to this kind of problems.

A first variant is shown in U.S. Pat. No. 3,500,829 which discloses piercing of ear lobes, where the bar is provided with a cannula which after piercing is pressed into a cannula catcher which is held by the operator's one hand against the rear side of the ear lobe. Piercing is adapted to take place completely manually with the risks of infection and spreading of infectious matter that are involved.

A second solution is given in U.S. Pat. No. 5,709,700 which discloses an embodiment of a disposable instrument for piercing of ear lobes. The instrument comprises a cartridge containing a piece of ear jewelry, a cannula, a mechanism for receiving the cannula and a pressure mechanism. The pressure mechanism comprises a spring-loaded push rod by means of which the cannula, together with the bar arranged on the same, is pushed through the ear lobe. In this position, the cannula is pushed into and received against a two-piece spring-loaded cannula catcher. On completion of piercing, the cannula catcher springs up to expose the cannula which is then removed manually and arranged in a cannula compartment arranged in the cartridge. The instrument is designed for piercing of ear lobes and, like other instruments that are known for this purpose, is inconvenient for use on other parts of the body owing to all the circumstances that have been described above. Moreover the mechanical construction results in high costs of the disposable instrument. Further, although it is a disposable instrument, the document does not disclose a technique which is acceptable from the point of view of asepsis since the operator, after piercing, is forced to touch the cannula.

All the above described technical solutions and methods for piercing of ear lobes as well as other parts of the body also suffer from a drawback which affects safety in piercing. Two steps that are critical in piercing are performed at the same time or immediately in succession, which increases the risk of something going wrong in piercing. The step where the operator aligns the piercing means with the entry and, optionally, the exit hole, and the step where the operator performs the actual piercing through the skin portion must with all prior art techniques be performed in the same step or in two steps in close succession. As a result, the actual piercing step can be experienced by the operator to be dramatic. Moreover the risk of failure will always be greater when two critical steps are to be performed at the same time or in close succession.

There is thus a need for a technique for piercing body parts and skin portions which presents easy handling, which provides an aseptic technique with regard to both the person who is being pierced and the operator, which separates the sighting step from the piercing step, and which is not limited to use on a specific body part or a specific skin portion.

OBJECTS OF THE INVENTION

The object of the present invention is to provide a system with integrated asepsis for piercing and positioning a piece of body jewelry or a piece of ear jewelry. The system should thus minimise the risk of infection and blood infection for both the person being pierced and the operator.

It is also an object to provide a system for piercing which distinctly separates and allows a distinct separation between the actual sighting step and the actual piercing step.

A further object is that the system should be easy to use to provide high quality piercing.

Another object is to provide a system for piercing, where the construction of the system is not limited to use on a specific body part or a specific skin portion.

Yet another object is to provide a system which is easy to manufacture and can be manufactured at low cost.

An additional object is that the system should above all be disposable.

SUMMARY OF THE INVENTION

To achieve the above objects and further objects not stated, which will be evident from the following description, the present invention concerns a cartridge, a pinching and sighting device and also a catching device for piercing and positioning a piece of body jewelry or a piece of ear jewelry in a skin portion. The invention also concerns a system for piercing and positioning a piece of body jewelry or a piece of ear jewelry in a skin portion and also a method of preparation before piercing and positioning a piece of body jewelry or ear jewelry.

In the following the term piercing means refers to a sharp means which is suitable for piercing of a skin portion. The piercing means may consist of, for example, a cannula which is arranged on or loosely adjacent to the front end of the bar of a piece of a body jewelry or ear jewelry. The piercing means can also be integrated with the bar in the form of a sharp tip at its front end, which tip can be adapted to be removed or not removed after piercing.

The term skin portion is also adapted to comprise a mucous membrane.

According to a first aspect the invention concerns a cartridge intended for use in a system for piercing and positioning a piece of body jewelry or ear jewelry in a skin portion, which cartridge is adapted to accommodate a piece of body jewelry or ear jewelry comprising a bar and an associated piercing means. The cartridge is characterised in that it comprises means for arranging and aligning said cartridge with a pinching and sighting device adapted to grip said skin portion in the skin-gripping state of the pinching and sighting device, and a cavity, in which a pressing means, which is separate from said pinching and sighting device, is movable to press out a piercing means arranged in the cartridge and at least part of the bar of a piece of body jewelry or ear jewelry arranged in the cartridge through an opening formed in the cartridge.

By the cartridge being arranged to the pinching and sighting device is meant stable positioning of the cartridge relative to the pinching and sighting device, which can take place by mechanical locking or gripping means but also manually, or by a combination of mechanical and manual gripping.

The inventive cartridge presents a number of advantages. It can be used on pieces of body jewelry as well as ear jewelry and can be used whether the bar of the piece of jewelry is straight like in a conventional piece of body jewelry or ear jewelry, or bent like in a piece of body jewelry which is intended for a navel for instance. Furthermore it can be used independently of the form of piercing means, that is whether the piercing means is an integrated part of the bar or a cannula arranged thereto or some other sharp means.

The inventive cartridge can be provided as a sterile disposable unit comprising a piece of body jewelry or ear jewelry and an associated piercing means.

Before, during and after piercing, the cartridge can be handled and operated without the operator risking to come into contact with the piece of body jewelry or ear jewelry, its piercing means and the parts of the cartridge that come into contact with or close to the skin portion that is to be penetrated or that has been penetrated. Moreover the contact between the cartridge and the skin portion before, during and after piercing can be reduced to a minimum since the pinching and sighting device can be arranged therebetween. Taken together, this reduces the risk of infection and transfer of blood infectious to a minimum, both to the person being pierced and to the operator. Thus the inventive cartridge facilitates an aseptic process.

By the cartridge being adapted to be arranged to a pinching and sighting device and by the device obtaining an alignment relative to the same, the quality of piercing increases. Of course, this applies provided that the skin portion has been positioned and gripped correctly in the pinching and sighting device in such a manner that at least the desired entry hole is aligned with the opening of the cartridge and, thus, the tip of the piercing means. An optimal alignment is obtained if the desired entry hole and exit hole for piercing are oriented opposite each other when the skin portion is gripped in the pinching and sighting device. If so, the cartridge will, by being arranged to the pinching and sighting device, ensure that piercing takes place in the desired position, that is the piercing means will be pressed by the pressing means through and between the desired entry hole and exit hole. The actual handling of the cartridge before and during piercing is simple, which requires less operator experience than in piercing according to prior art technique.

By the cartridge being adapted to be arranged on the pinching and sighting device only after the desired positions of entry hole and exit hole, or at least the position of the desired entry hole, have been aligned, a distinct separation between the actual sighting step and the actual piercing step is obtained, which means that the entire piercing operation is rendered less dramatic and the risk of incorrect piercing is reduced to a minimum.

Moreover the cartridge is very simple in construction and can thus be provided at a low cost and to be disposable.

By the cartridge being adapted to cooperate with a pinching and sighting device, it is not restricted to use on a specific body part or specific skin portion since it is the pinching and sighting device that ensures the pinching of the body part or skin portion.

Said pressing means can be integrated with the cartridge or be arranged in a separate module. Such a separate module may consist of, for instance, an instrument by means of which also the cartridge is arranged to the pinching and sighting device, and by means of which also the pressing means is operated. Such an instrument can be a multiple-use instrument.

The cartridge comprises preferably a first and a second half, which halves between them define grooves for receiving and guiding said piercing means.

The use of two halves is advantageous since it allows easy and inexpensive manufacture of the cartridge, which is important in view of the idea that the cartridge should be suitable for one-time use. Furthermore mounting and guiding of the piece of body jewelry or ear jewelry and the piercing means in the cartridge will be easy and reliable, which is an important aspect for the quality of the piercing, but also for the cost of the cartridge.

Said grooves may comprise a first groove for receiving and guiding said piercing means and the bar of the piece of body jewelry or ear jewelry, and a second groove for receiving and guiding the rear end of the bar of the piece of body jewelry or ear jewelry, the first and the second grooves merging adjacent to said opening. This solution is applicable to a piece of body jewelry having a bent bar and a locking means arranged on the bar, which is the case of a piece of body jewelry intended for the user's navel.

If the cartridge comprises two grooves as stated above, the second groove may have a curvature arranged towards the first groove. By the second groove being bent, the bar can by passing through the skin portion, despite its curvature, be allowed to substantially follow the passage that has been created by the piercing means through the skin portion, which passage corresponds to a straight line. As a result, trauma is reduced to a minimum. The curvature of the groove and the curvature of the bar thus strive to balance each other to create as narrow a passage as possible through the pinched skin portion. This makes it possible to imitate the "digging" motion performed by the operator to reduce trauma in manual piercing and mounting of a piece of body jewelry having a bent bar.

The pressing means can be adapted to perform a linear motion inside said cartridge.

The first and the second half can be articulated to each other on the upper side of the cartridge. This means that, when exposing the piece of body jewelry after piercing and mounting, the two halves can easily be moved apart away from the skin portion, which means that there is no risk of getting stuck in the skin portion or being obstructed by the body of the person in which piercing has taken place. Moreover during such a movement the contact with the skin portion involved is reduced to a minimum, which is important to reduce the risk of infection and spreading of infectious matter.

The first and the second half can be interlockable to form a closed cartridge. The cartridge can thus be provided as a closed cartridge containing a piece of body jewelry or ear jewelry and an associated piercing means which is ready for use. This means that the user need not handle the piece of jewelry or ear jewelry and the piercing means with the risk of contaminating them before or during piercing. It is also ensured that the piece of jewelry or ear jewelry and the piercing means are correctly oriented and positioned in the cartridge before piercing.

The first and the second half can be interlockable by a locking device, which locking device comprises interposable fingers arranged in the respective halves, which fingers in the interposed state define a channel to allow insertion of a locking cotter pin. This results in a locking device which, except for the cotter pin, can be manufactured by, for example, injection moulding and integrated with the cartridge.

The means of the cartridge may comprise at least one locking pin which is operable about its own longitudinal axis, the locking pin being movable to a position in which the locking means is in locking engagement with the pinching and sighting device.

The cartridge may comprise a catching device which is arranged opposite said opening, which catching device can be integrated with the cartridge or be arranged directly or indirectly to the same.

As an alternative to said catching device, the cartridge may comprise a locking means holder which is arranged opposite said opening, which locking means holder can be integrated with the cartridge or be arranged directly or indirectly to the same.

As an alternative to a catching device or a locking means holder, the cartridge may comprise a combination of the two. The cartridge then comprises a catching device which is integrated with the locking means holder or which is arranged directly or indirectly on the same.

According to another aspect, the invention concerns a pinching and sighting device adapted to be used in a system for piercing and positioning a piece of body jewelry or a piece of ear jewelry in a skin portion, said pinching and sighting device comprising first and second gripping means which are adapted to grip a skin portion between them. The pinching and sighting device is characterised by at least one aiming means, which aiming means is adapted to allow alignment of the pinching and sighting device relative to at least the position of a desired entry hole for piercing, and in that at least one of said gripping means comprises means for arranging a cartridge as claimed in any one of claims 1-14 for the pinching and sighting device, and for aligning said cartridge relative to said position of the desired entry hole.

The aiming means may, of course, also be used so that the pinching and sighting device is aligned with both the desired entry hole and exit hole and so that these are arranged opposite to each other. The subsequent arrangement of the cartridge to the means of the pinching and sighting device ensures that the cartridge with its opening for the piercing means is correctly aligned relative to at least the position of the desired entry hole. This results in high quality piercing while at the same time the requirements placed on the experience of the operator are reduced. Furthermore the pinching and sighting device allows and facilitates an aseptic process.

The aiming means can be arranged so as to allow alignment of the pinching and sighting device even if the point of the desired entry hole is not made visible. The aiming means may, for instance, consist of recesses which expose the desired position, whereby this is made clearly visible; it can also be in the form of, for example, a transparent and penetratable membrane or hairline cross or the like.

Said means on the pinching and sighting device can be complementary to the means arranged on the cartridge.

At least one of said gripping means may further comprise means for direct or indirect arrangement of a catching device to the pinching and sighting device. A catching device is used if the piercing means consists of a sharp tip which is loosely or releasably connected to the piece of body jewelry or ear jewelry and which is adapted to be removed from the piece of body jewelry or ear jewelry. By the catching device being supported directly or indirectly by the pinching and sighting device during piercing, the operator can concentrate on holding the pinching and sighting device and operating the cartridge during piercing, instead of, like in prior art, having to hold the catching device by his one hand. At the same time it is ensured that a catching device is actually used, which reduces the risk of spreading contagious matter, but also the risk that the operator is injured by the sharp piercing means. The use of the catching device, together with the pinching and sighting device and the cartridge, further results in a "closed" path for the piercing means while passing out of the cartridge, through the skin portion and into the catching device, which also contributes to reducing the risk of infection and preventing the spreading of blood infection. Thus, an aseptic process is allowed.

As an alternative to a catching device, the pinching and sighting device may comprise a locking means holder, which locking means holder can be integrated with the pinching and sighting device or be loosely arranged thereto. This is preferably used if the piercing means is integrated with and consists of the bar and where the piercing means and the bar are adapted, in conjunction with the piercing operation, to be pressed directly into a locking means for locking engagement, which is the case for typical pieces of ear jewelry for instance. The locking means may, for example, be a leaf spring which works by friction or a locking means which by a squeezing effect radially grips the bar. With this solution, the operator need not at all handle the locking means and thus does not run the risk of contacting the piece of body jewelry or ear jewelry or the skin portion. Consequently the risk of infection and transfer of blood infection is reduced to a minimum. Also this part of the invention thus allows and simplifies an aseptic process in piercing.

As an alternative to a single catching device and a single locking means holder, the pinching and sighting device may comprise a combination of these two alternatives. Then the pinching and sighting device comprises a catching device, which catching device is integrated with or arranged directly or indirectly on the locking means holder. This is advantageous in the cases where the piercing means consists of a sharp releasable tip and this tip during piercing is pressed through the locking means received in the locking means holder to be caught by the catching device in the same sequence in which the bar is inserted into the locking means for locking engagement.

According to yet another aspect, the invention concerns a catching device which is adapted to be used in a system for piercing and positioning a piece of body jewelry or a piece of ear jewelry in a skin portion, comprising a means for catching and retaining a piercing means, which piercing means consists of a sharp tip which is loosely or releasably connected to the piece of body jewelry or ear jewelry. The catching device is characterised by means for arranging said catching device directly or indirectly to a pinching and sighting device or cartridge.

As mentioned above, a catching device is used in the cases where the piece of body jewelry or ear jewelry is provided with a loosely or releasably connected sharp tip. The advantages of a catching device have already been discussed in connection with the pinching and sighting device and will therefore not be repeated here.

The means for catching and retaining the piercing means can be a membrane.

According to a further aspect, the invention concerns a system for piercing and positioning a piece of body jewelry or ear jewelry in a skin portion, comprising a cartridge as claimed in any one of claims 1-14 and a pinching and sighting device as claimed in any one of claims 15-20.

The hygienic and aseptic advantages of the inventive pinching and sighting device and the inventive cartridge have been described above, separately and in cooperation with each other. A system comprising these two parts allows an aseptic process by closed handling of at least the piercing means while passing out of the cartridge and through the skin portion in which piercing takes place.

It has also been described above that the cartridge and the pinching and sighting device are adapted to engage and cooperate with each other in such a manner that the system is easy to use and requires little operator experience. The system also allows high quality piercing by the operator, before and during piercing, being capable of having complete control of the desired entry hole and exit hole, or at least the desired entry hole. The system allows a distinct separation of the actual sighting step and the piercing step. This renders the piercing operation less dramatic, which in turn guarantees high quality piercing.

The parts included in the system are also designed so that the system is not restricted to use on a specific skin portion, for positioning a certain type of jewelry, a piece of jewelry with a certain type of bar geometry, a piece of jewelry with a certain type of locking means or for a certain type of piercing means. The simple design also results in a system which is easy to manufacture and which can be manufactured at low cost. This makes the system well suited to be disposable.

The system may comprise a catching device as claimed in any one of claims 21-22. As mentioned above, a catching device is used in the cases where the piece of body jewelry or ear jewelry is provided with a loosely or releasably connected sharp tip.

The system may comprise a clip and, arranged therein, a locking means which is adapted to be arranged on a piece of body jewelry arranged in the skin portion. The use of a clip for mounting of the locking means implies that the operator need not handle the locking means manually or run the risk of coming into contact with the bar or the skin portion during this operation. This reduces the risk of infection and transfer of blood infection to a minimum. Such a clip thus contributes to an aseptic process in piercing.

In the case where the bar is adapted, in connection with the piercing operation, to be pressed directly into a locking means for locking engagement, it is advantageous if the system comprises a locking means holder, in which the locking means is arranged. The use of a locking means holder is an alternative to said catching device. With such a locking means holder, the operator need not handle the locking means, thus reducing the risk of infection and transfer of blood infection to a minimum.

The system may further comprise an instrument for arranging said cartridge for said pinching and sighting device, and the instrument also allows operation of a pressing means arranged to the cartridge.

According to another aspect, the invention concerns a method or preparation before piercing and positioning a piece of body jewelry or a piece of ear jewelry in a skin portion. The method comprises gripping by means of a pinching and sighting device the skin portion intended for piercing in such a manner that desired positions of entry hole and exit hole are arranged opposite to each other, and arranging to said pinching and sighting device a cartridge holding a piece of body jewelry or a piece of ear jewelry comprising a bar and an associated piercing means, the piercing means by the arrangement of the cartridge to the pinching and sighting device obtaining an alignment relative to at least said desired position of the entry hole.

With this method, the above objects and the above advantages are achieved, and therefore the advantages will not be repeated here.

Said arrangement and alignment of the cartridge can be obtained by complementary means arranged to the pinching and sighting device and the cartridge, respectively.

The method may further comprise arranging, directly or indirectly, to the pinching and sighting device a catching device opposite the cartridge.

DESCRIPTION OF DRAWINGS

The invention will now be described in more detail by way of example and with reference to the accompanying drawings, which illustrate a currently preferred embodiment.

TECHNICAL DESCRIPTION

The inventive system and the parts included therein are intended for piercing and positioning a piece of body jewelry or ear jewelry in a skin portion.

A frequently used variant of a piece of body jewelry comprises an elongate bar. If the piece of body jewelry is intended for use in a navel, the bar is usually bent. The bar has a first end which comprises a first locking means in the form of a detachable lock, and a second end which comprises a second locking means whose primary purpose is to form a stop means to prevent the piece of the body jewelry from being pulled out of the skin portion. The second locking means, which frequently is a decoration, is usually fixedly arranged on the bar by, for example, soldering or gluing and is frequently not adapted to be detachable. The first locking means can be designed in various ways and the most frequent variant is a ball which is threaded onto the bar. In piercing, before positioning a piece of body jewelry, a piercing means in the form of a cannula is often used.

On the other hand, a piece of ear jewelry comprises in its simplest embodiment a straight bar which at one end has a fixedly secured locking means. This fixedly secured locking means is the actual piece of jewelry. To retain the piece of ear jewelry, use is made of a locking means which is locked against the bar, mainly by friction. The bar of a piece of ear jewelry may comprise at its front end a sharp tip which is used as piercing means.

Figure 1:
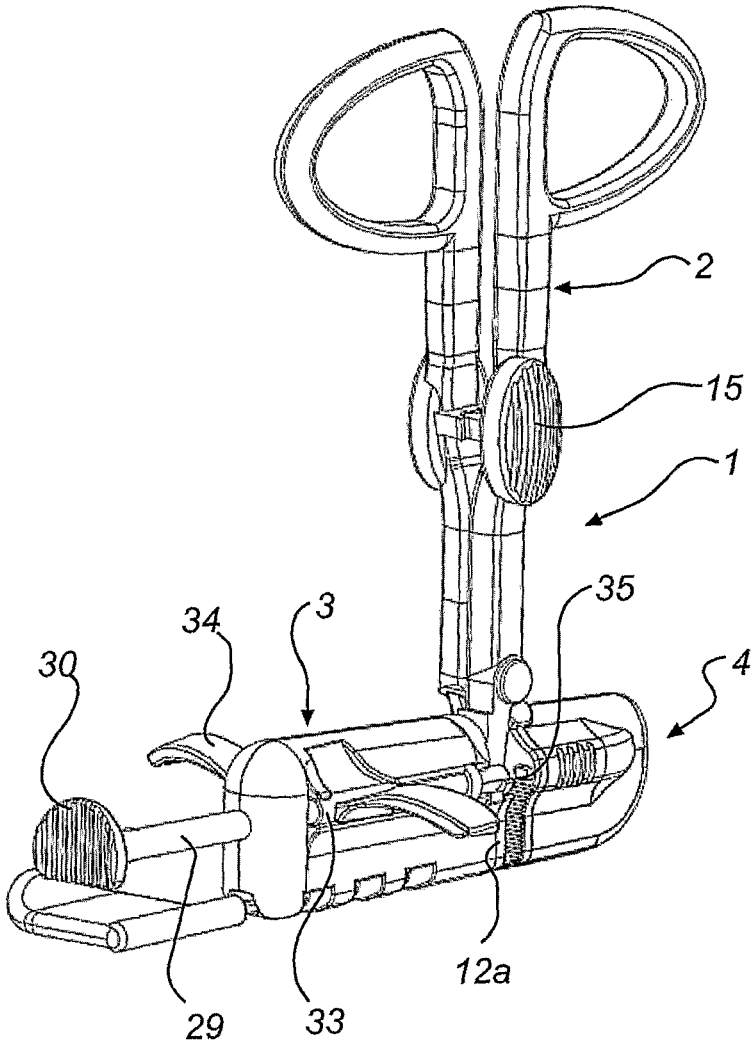
FIG. 1 shows a system according to the invention comprising a pinching and sighting device, a catching device and a cartridge.

Reference is now made to FIG. 1, which shows a system 1 according to the invention. The shown system comprises three parts cooperating with each other, viz. a pinching and sighting device 2, a cartridge 3 and a catching device 4. The system 1 may also comprise a clip 5, see FIG. 8, for mounting a locking means 105 on the piece of body jewelry. Furthermore the system 1 may, as an alternative or to supplement the catching device 4, comprise a locking means holder (not shown). The two parts which are most important for the system 1 are, however, the pinching and sighting device 2 and the cartridge 3. The system will in the following be described based on a piece of body jewelry with a bent bar and using a piercing means in the form of a cannula.

Figure 2:
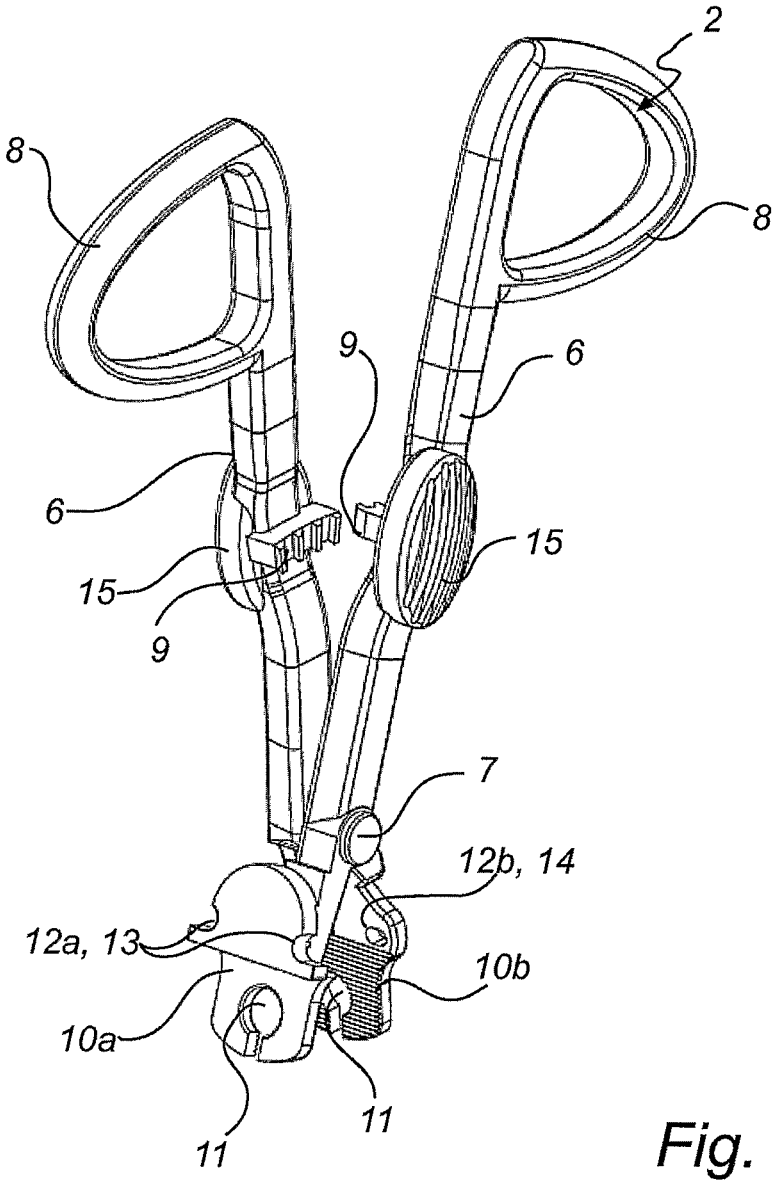
FIG. 2 is a perspective view of the inventive pinching and sighting device.
Figure 3:
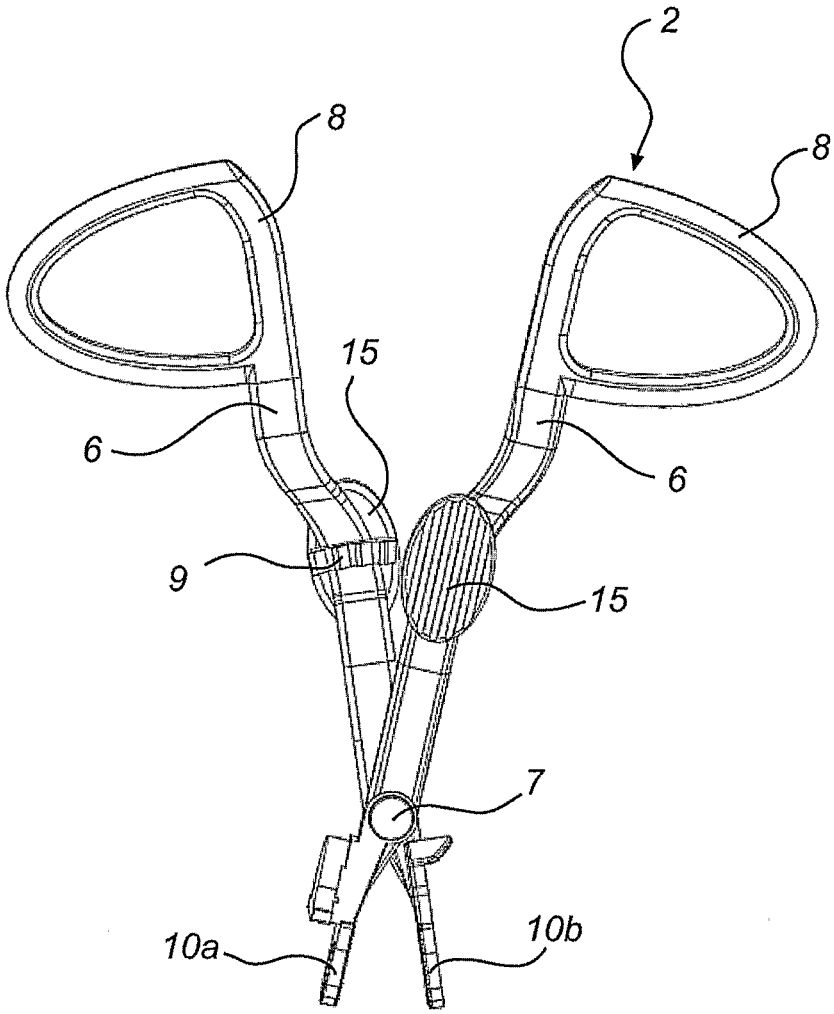
FIG. 3 is a top plan view of the inventive pinching and sighting device.

With reference to FIGS. 2 and 3, an embodiment of a pinching and sighting device 2 according to the invention is shown. The pinching and sighting device 2 comprises first and second legs 6 which are articulated to each other by a hinge 7. The upper parts of the legs 6 comprise gripping surfaces 8 in the form of loops, by means of which the operator can grip and actuate the pinching and sighting device 2. Between these gripping surfaces 8 and said hinge 7 there are two complementary locking portions 9 which allow mutual locking of the two legs 6.

The lower parts of the legs 6, that is below said hinge, comprise gripping means 10*a*, 10*b* between which the skin portion to be pierced is adapted to be pinched. In the embodiment illustrated, the gripping means 10*a*, 10*b* are arranged as opposite grooved plates, each with an aiming means in the form of through holes 11 for exposing and thus allowing access from both sides of a skin portion that is pinched between them.

The first gripping means 10*a* comprises first means 12*a* which are adapted to cooperate with complementary means of a cartridge that will be described below. Moreover the second gripping means 10*b* comprises second means 12*b* which are adapted to cooperate with complementary means of a catching device which will also be described below.

The first means 12*a*, see FIG. 2, comprises a plate with two through recesses 13 which are each arranged on an edge of the plate in such a manner that their periphery is positioned partly outside the edge. The recess 13 which, in this way, is formed on each edge is of such a size that a stop means arranged on the cartridge can pass axially through the recess, provided that it is correctly oriented relative to the same. The recess 13 is also of such a size that the stop means can pass through the recess in the radial direction. The stop means will be described below in connection with the cartridge.

The second means 12*b* is arranged as a plate with two holes 14 for receiving complementary pins of the catching device which is adapted to be arranged on the same.

The shown pinching and sighting device 2 also comprises two additional gripping surfaces 15 which are positioned so as to prevent the operator from unintentionally releasing the locking obtained by the locking portions 9 if/when he holds the pinching and sighting device 2 during the piercing operation for instance.

The pinching and sighting device 2 is advantageously formed in two pieces which are joined by said hinge 7. Each part is preferably made by injection moulding of a polymer material. The pinching and sighting device 2 is advantageously intended to be disposable. It will be appreciated that the pinching and sighting device 2 can be designed in various ways with its function maintained and that the described embodiment is only one conceivable design.

Figure 5:
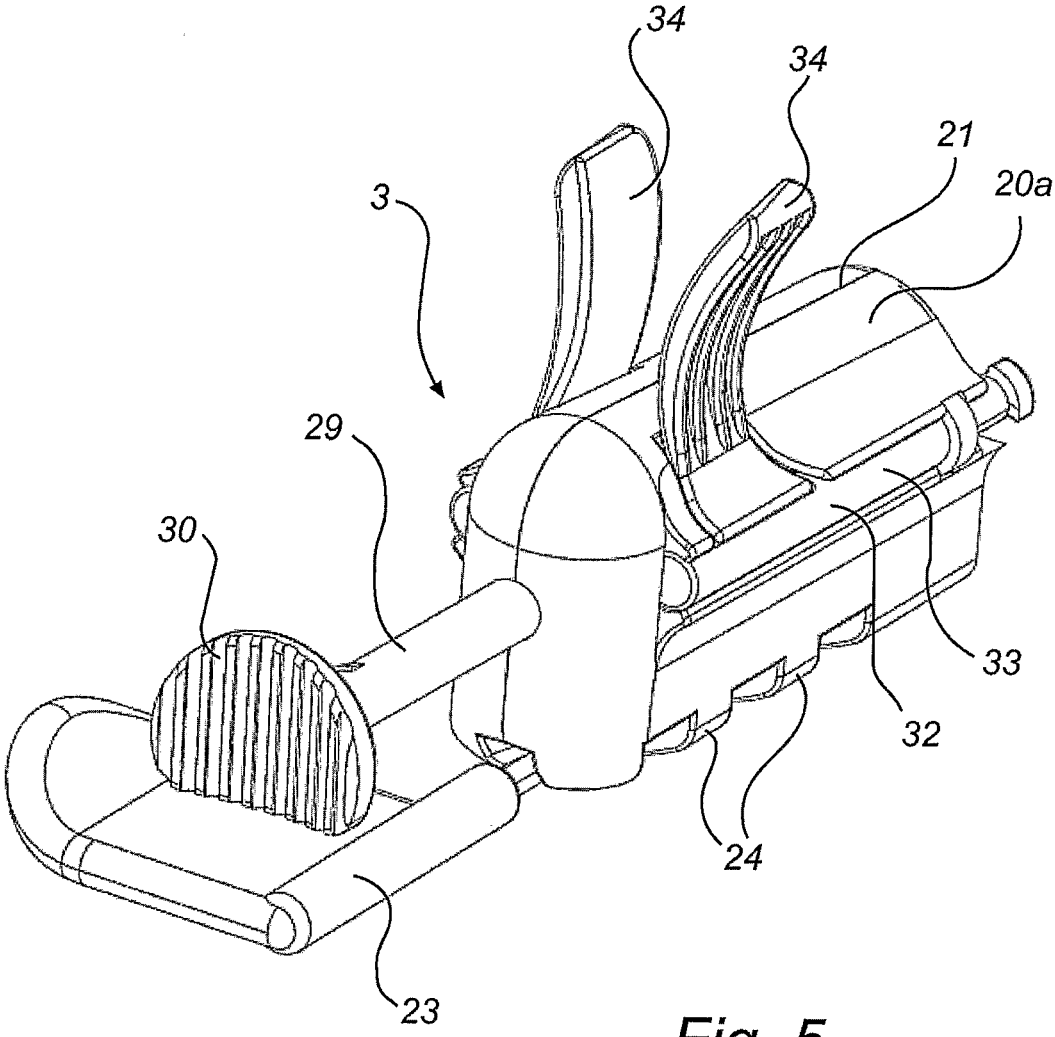
FIGS. 5 and 6 are perspective views seen obliquely from behind and seen obliquely from the front, respectively, of a cartridge according to the invention.
Figure 6:
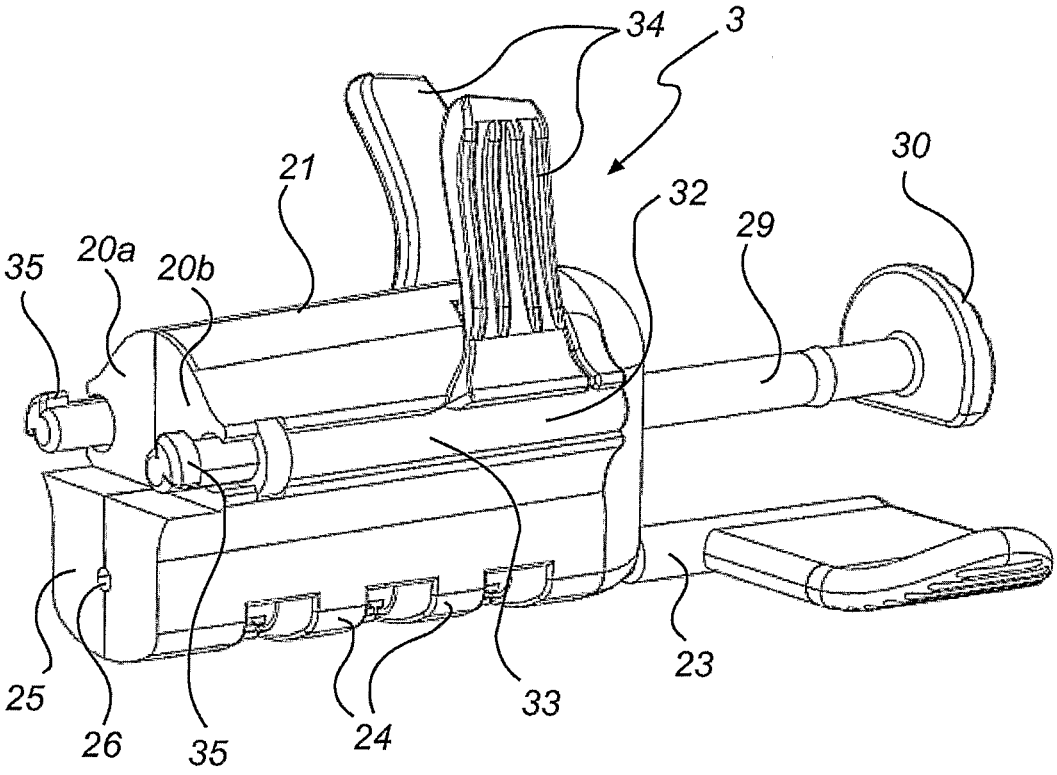

With reference to FIGS. 5 and 6, a preferred embodiment of the inventive cartridge 3 is shown, seen obliquely from behind and obliquely from the front respectively.

The cartridge 3 comprises two halves 20*a*, 20*b* which are articulated to each other by a pivot 21 which extends along the upper side of the cartridge. In the shown embodiment, the pivot 21 is made of a locally thinner material.

The two halves 20, 20*b* are lockable to each other on the underside of the cartridge 3 to form a closed cartridge. In the embodiment illustrated, this takes place by means of a pull-out cotter pin 23 which is arranged through a channel defined by fingers 24 on the underside of the respective halves 20*a*, 20*b*. The fingers 24 are arranged relative to each other so that they mesh with each other and define said channel when the two halves 20*a*, 20*b* are brought together.

The front end 25 of the cartridge 3 comprises an opening 26 through which a piercing means and at least part of an associated bar of the piece of body jewelry is adapted to be pressed out.

Figure 7:
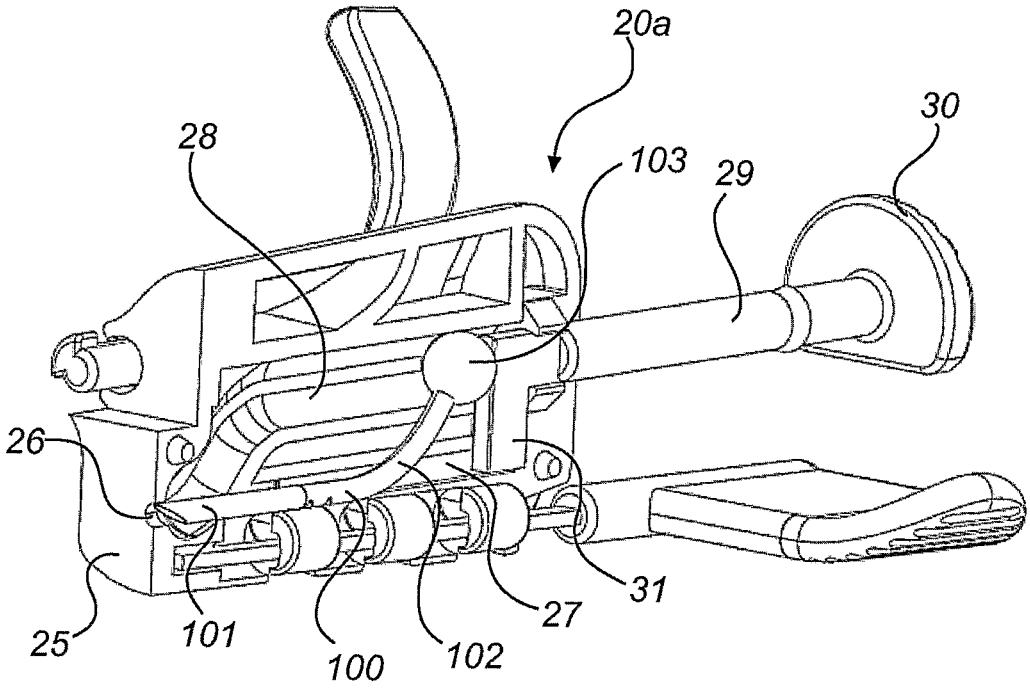
FIG. 7 shows schematically the inside of one half of the cartridge.

Now with reference to FIG. 7, an inside of a first cartridge half 20*a* is shown. The cartridge half 20*a* is illustrated with a piece of body jewelry 100 and a piercing means 101 which is arranged to the front end of the piece of body jewelry, which are accommodated in a cavity defined between the two halves.

In the shown embodiment, the piercing means 101 consists of a cannula. The shown piece of body jewelry 100 is intended to be a piece of navel jewelry and has a bent bar 102, which is typical for a piece of navel jewelry.

The piercing means 101 and part of the bar 102 are received in a lower groove 27 in the cavity while the locking means 103 is received in an upper groove 28 in the cavity. Behind the piece of body jewelry, a push rod 29 is shown, which is also illustrated in FIGS. 5 and 6.

The push rod 29 is received in the cavity between the two cartridge halves 20*a*, 20*b* and is guided between them. The push rod 29 comprises at its rear end a button 30 for operating the push rod and at its front end a pressing means 31 which in FIG. 7 is shown to abut against the locking means 103. By applying a pressure to the button 30, the push rod 29 is moved through the cartridge 3 and can, by the abutment of the pressing means 31 against the locking means 103, press the piercing means 101 and part of the bar 102 out of the opening 26.

In the embodiment illustrated, the upper groove 28 has a curvature towards the lower groove 27. By the upper groove 28 being curved, the bar 102 can, by passing through a skin portion, despite its curvature, be made to substantially follow the passage formed by the piercing means 101 through the skin portion. As a result, trauma is reduced to a minimum.

If the cartridge 3 is intended for pieces of body jewelry with straight bars, such as for pieces of ear jewelry, the upper curved groove can be replaced by a groove of the same axial extent as the opening 26.

Each half 20*a*, 20*b* comprises on its outside a means 32 with a bayonet socket, see FIGS. 5 and 6. The means 32 comprises a locking pin 33 which extends in the longitudinal direction of the cartridge. The locking pin 33 has a radially projecting gripping surface 34 for actuating the locking pin 33 about its own longitudinal axis. The front end of the locking pin 33 comprises a stop means 35 in the form of a radial projection. The stop means 35 preferably has the same radial direction as said radial gripping surface 34. The stop means 35 is adapted to cooperate with the recesses 13 in the first means 12*a* of the pinching and sighting device 2.

The cartridge 3 and its parts are preferably made by injection moulding of a polymer material.

The cartridge 3 is preferably provided as a unit, containing a piece of body jewelry or ear jewelry 100 and an associated piercing means 101.

Figure 9:
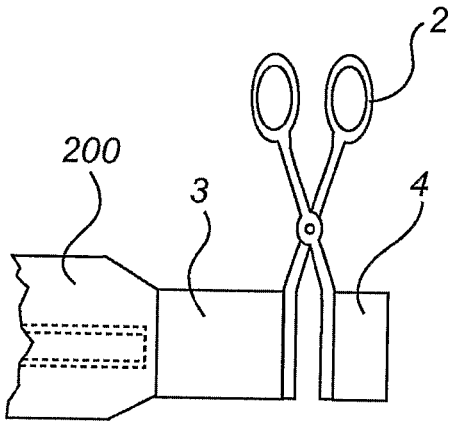
FIG. 9 shows schematically a module comprising a pressing means, which module is arranged on the cartridge.

The cartridge 3 has been described above to comprise an integrated pressing means 31. It will be appreciated that the pressing means 31 with its function maintained can also be provided as a separate module 200 which is arranged on or to the cassette. The module 200 may, for example, consist of a multiple-use instrument by which the cartridge 3 is arranged on or to the pinching and sighting device 2, which instrument comprises pressing means 31' and associated operating means. This is shown highly schematically in FIG. 9.

It will be appreciated that the opening formed in the cartridge can be created in conjunction with the pressing of a piercing means through a membrane which forms a front wall in the cartridge.

Figure 4A:
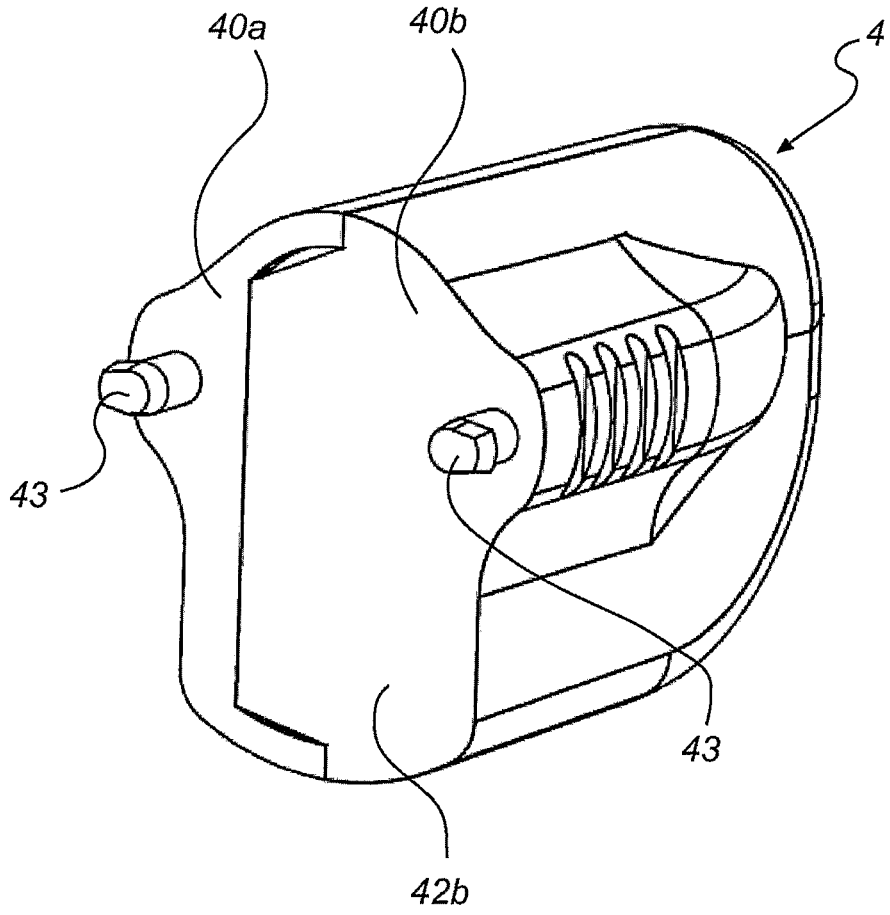
FIGS. 4*a* and 4*b* show parts of a catching device which is intended for use in the system.
Figure 4B:
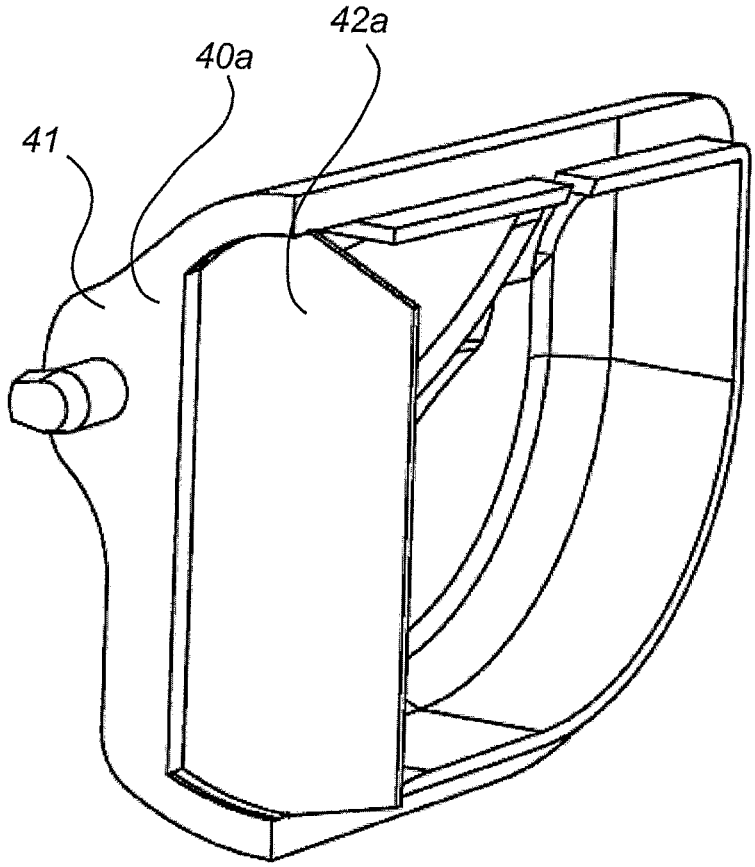

FIGS. 4*a* and 4*b* illustrate an embodiment of a catching device 4 according to the invention. The catching device 4 is intended to be used with piercing means which are not integrated with the bar.

The catching device 4 can be designed in various ways, but the primary thing is that the piercing means 101, after piercing, is retained in or inside the device in such a manner that the operator can handle the catching device 4 without having to come into contact with the piercing means 101.

The shown catching device 4 comprises two halves 40*a*, 40*b* which advantageously are injected moulded of a polymer material. The first half 40*a*, see FIG. 4*b*, has at its front end 41 a thin membrane 42 which is integrally formed therewith by injection moulding. The second half 40*b*, see FIG. 4*a*, is complementary to the first half 40*a* and is adapted to be arranged on the same to form a closed cavity. The second half 40*b* comprises, like the first half, a membrane 42*b* at its front end. It will be appreciated that instead of using double membranes, it is possible to use a single membrane.

The two halves 40*a*, 40*b* further comprise means 43 in the form of pins. The means 43 are complementary to the means 12*b* of the second gripping means 10*b* of the pinching and sighting device 2 and are arranged so that the catching device 4 can be pushed in place thereon. It will be appreciated that the catching device 4 can be arranged to the pinching and sighting device 4 in various ways in addition to the way described above. Within the scope of the invention, the catching means can be arranged directly or indirectly thereto or even be integrated with the pinching and sighting device.

As an alternative to membranes 42*a*, 42*b*, the catching device 4 may comprise an internal member of, for example, a flexible plastic or rubber material, such as cellular plastic.

Figure 8:
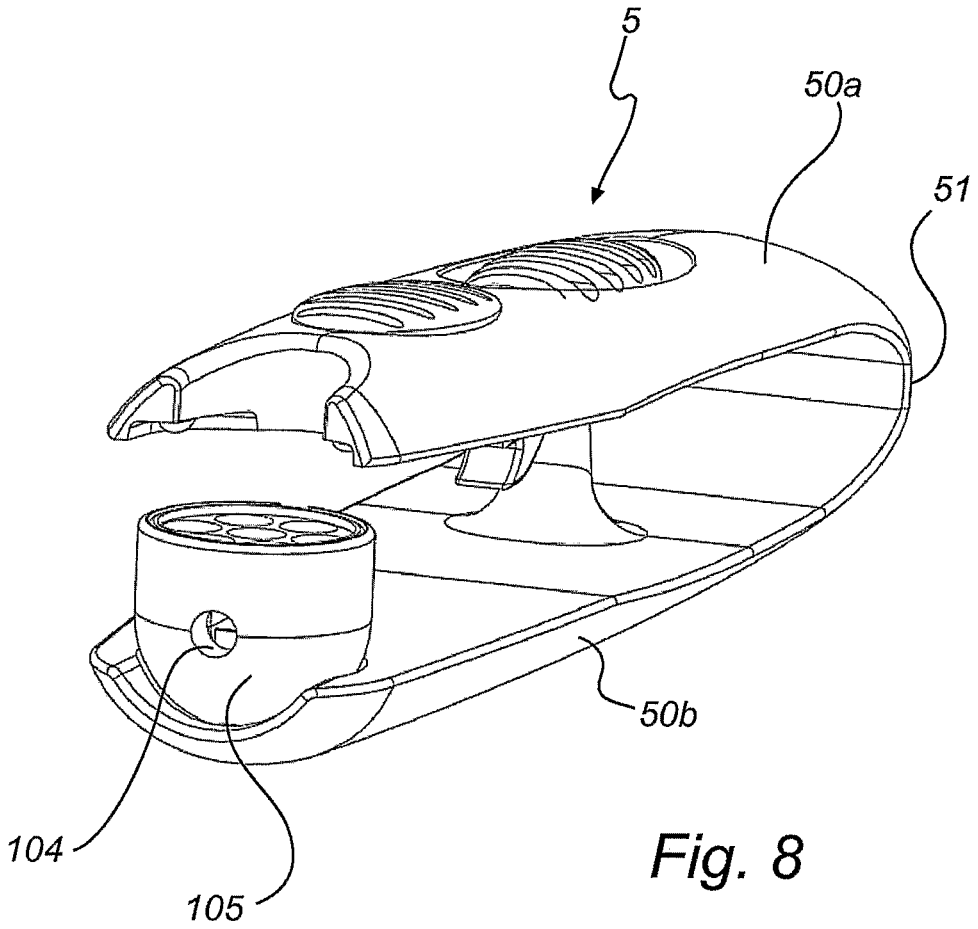
FIG. 8 shows a clip with a locking means arranged therein.

With reference to FIG. 8, an embodiment of a clip 5 is shown, which is suitable for use when mounting a locking means 105 on the bar 102 after arranging a piece of body jewelry or ear jewelry 100 in a skin portion.

The clip 5 comprises a first and a second leg 50*a*, 50*b* which are interconnected by a joint 51. The clip 5 can be resembled to a pair of tweezers and is preferably provided with a locking means 105 arranged therein. The locking means 105 is preferably arranged in the clip 5 so that the hole 104 which is formed in the locking means 105, through which hole the bar 102 of the piece of body jewelry or ear jewelry 100 is adapted to be inserted and locked, is directed away from the clip 5 and aligned with the longitudinal axis of the clip.

Depending on the construction of the locking means, the locking means can, for instance, be threaded onto the bar while at the same time the locking means is gripped by the clip.

With new reference to FIG. 1-8, the handling of a system 1 according to the invention will be described with regard to piercing and positioning a piece of body jewelry with a bent bar in a user's navel.

First the desired entry and exit holes are marked, after which the operator disinfects the skin portion (not shown) in and around the navel. Subsequently this skin portion is pinched by the pinching and sighting device 2 in such a manner that the marks are centred in the holes 11 in the gripping means 10 of the pinching and sighting device 2, which holes constitute aiming means. This ensures that the two marks and, consequently, the desired entry and exit holes are arranged opposite each other. The marks are visible in spite of the pinching since the skin portion is exposed through the holes of the gripping means. It will be appreciated that this alignment can take place in different ways and that the aiming means used for the purpose can be of different designs, of which the shown and described is only one possible design.

After that, the cartridge 3 is arranged to the first gripping means 10*a* of the pinching and sighting device 2 and its means 12*a*. Preferably the cartridge is delivered with the radial gripping surfaces 34 facing upwards, whereby the stop means 35 of each locking pin 33 is oriented so that it can be inserted through the recess 13 in the first means 12*a*. The cartridge 3 is arranged on the pinching and sighting device 2 so that the front end 25 of the cartridge abuts against the first means 12*a* thereof. In this position, the radial gripping surfaces 34 are turned down, whereby also the radial stop means 35 are turned relative to the recesses 13 in the first means 12*a* to such a position that the stop means 35 are pre-vented from passing out of the recesses in the longitudinal direction of the locking pin 33. The cartridge 3 is now fixedly arranged on the pinching and sighting device 2. The cartridge 3 is further positioned in such a manner that the opening 26 in the front end 25, through which the piercing means 101 and at least part of the bar 102 of the piece of body jewelry 100 are adapted to be pressed out, is centred relative to the marks on the skin portion that is pinched in the gripping means 10 and exposed through its holes 11. The tip of the piercing means 101 is now aligned with the desired entry and exit holes.

Then the catching device 4 is mounted on the pinching and sighting device 2 by being snapped in place in the holes 14 in the means 12*b* of the second gripping means 10*b* of the pinching and sighting device. The system 1 is now prepared for the actual piercing.

For piercing, the two radial gripping surfaces 34 of the cartridge 3 are gripped by the operator with his forefinger and middle finger while at the same time he applies a pressure to the button 30 of the push rod 29 with his thumb. For increased stability, the pinching and sighting device 2 can at the same time be gripped using the two gripping surfaces 15. During this pressing motion, the pressing means 31 is pressed forward inside the cartridge 3 while at the same time it presses the piercing means 101 and part of the bar 102 through the skin portion which is pinched by the pinching and sighting device 2.

Once the piercing means 101 has passed through the skin portion, it is pressed into the catching device 4 where it is retained by the membranes 42*a*, 42*b* arranged therein. The front end position of the pressing means 31 is preferably arranged so as to correspond to a position where the piercing means 101 is completely received in the catching device 4 and the front end of the bar 102 is passed through the skin portion.

In this position, the catching device 4, now containing the used piercing means, is removed from the pinching and sighting device 2, thereby exposing the free front end of the bar 102. Before removing the cartridge 3 and the pinching and sighting device 2, a locking means 105 is mounted on the free end of the bar 102. How the locking means 105 is mounted depends on its construction. In a frequently used embodiment, the locking means is threaded onto the bar. This suitably takes place in the inventive system 1 by the locking means 105 being threaded in place while being gripped using the above described clip 5.

The cartridge 3 can now be removed. This takes place by the cotter pin 23 of the cartridge 3 being pulled out. Subsequently the radial gripping surfaces 14 are turned up towards each other. The two cartridge halves 20*a*, 20*b* can now be separated by a folding motion along the pivot 21. This folding motion is performed by the operator applying a pressure to the two radial gripping surface 34 to move them towards each other. During this folding motion, the radial stop means 35 of the locking pins 33 are allowed to pass in the radial direction through the recesses 13 in the first gripping means 10*a* of the pinching and sighting device 2. The piece of body jewelry 100 is now uncovered and the cartridge 3 can be removed. Finally, also the pinching and sighting means 2 can be removed.

If the system is intended for piercing with a piercing means which is integrated with a piece of body jewelry or ear jewelry, for example by the bar of the piece of body jewelry or ear jewelry having a sharp end which is integrated with the bar and forms a piercing means, it may be advantageous if the second gripping means of the pinching and sighting device comprises a locking means holder (not shown), for example in the form of a pocket with a locking means arranged therein. The locking means holder can be integrated with the pinching and sighting device or be supplied as a module which is arranged thereto instead of a catching device.

The steps before piercing involving marking of the desired entry and optionally exit hole, gripping with the pinching and sighting device and mounting of the cartridge are identical to the description above, but during the actual piercing operation, the bar of the piece of body jewelry or ear jewelry is pressed through the skin portion pinched by the pinching and sighting device and pressed into locking engagement with the locking means arranged in the locking means holder. Such a piercing operation is particularly common in piercing with and insertion of pieces of ear jewelry, in which case the locking means is fixed to the bar of the piece of ear jewelry mainly by friction.

It has been described above that the cartridge is arranged to the first gripping means of the pinching and sighting device, where the term "arranged" refers to stable positioning of the cartridge relative to the pinching and sighting device, which can take place by mechanical locking or gripping means but also manually, or a combination of mechanical and manual gripping.

Figure 10:
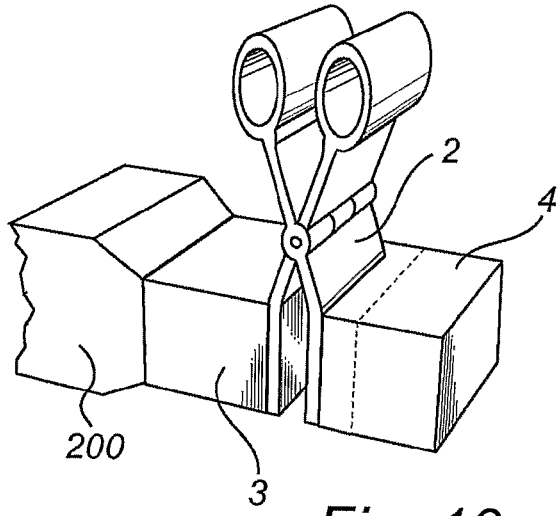
FIG. 10 shows schematically a cartridge which is arranged to grip and apply a pressure to the two gripping means of the pinching and sighting device.

It will be appreciated that the cartridge can be arranged both to the first and the second gripping means, individually or simultaneously. The cartridge can, for instance, as shown schematically in FIG. 10, be arranged to grip and, thus, be aligned with, or apply a pressure to the first and the second gripping means. In such a construction, a catching device 4 can, as illustrated, be arranged to the cartridge 3 and, thus, indirectly on the pinching and sighting device 2, opposite the opening of the cartridge. In this case the catching device can also be integrated, illustrated by the dashed line in FIG. 10, with the cartridge and, more specifically, so that it is oriented opposite the opening of the cartridge. If a locking means holder is used, it can be integrated with or arranged directly or indirectly on or to that part of the cartridge which is adapted to grip the gripping means of the pinching and sighting device, which gripping means is arranged opposite the opening of the cartridge. Of course, the locking means holder can also be arranged directly on the pinching and sighting device or be integrated with the same.

Figure 11:
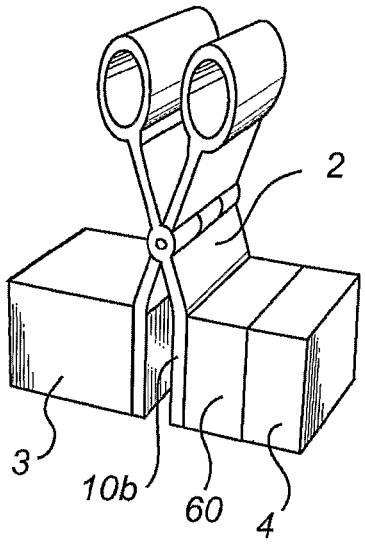
FIG. 11 illustrates schematically an embodiment of the system in which the catching device is arranged on the locking means holder which, in turn, is indirectly arranged on the cartridge via the pinching and sighting device.

With reference to FIG. 11, an embodiment is schematically illustrated, in which the catching device 4 is arranged on a locking means holder 60. The locking means holder 60, which is only illustrated highly schematically, consists of a holder supporting a locking means (not shown). The locking means holder 60 is, in turn, arranged on a gripping means 10*b* of the pinching and sighting device 2 in a position opposite the opening of the cartridge. This embodiment of the system is useful if the piercing means (not shown) consists of a sharp loose tip which is arranged on the bar of the piece of jewelry. During piercing, the bar of the piece of jewelry and the sharp tip supported by the bar will penetrate the skin portion and continue into the locking means which is supported by the locking means holder. The bar of the piece of jewelry will here lockingly engage the locking means while the sharp tip continues through the locking means and is instead received in the catching device 4. It will be appreciated that the catching device and the locking means holder can be integrated with or arranged on each other and that the combination catching device/locking means holder can be integrated with or arranged on the cartridge or on the pinching and sighting device.

Independently of the type of body part, the system 1 and its parts are suitably provided in the form of a complete sterile kit intended for a piercing operation. The kit preferably comprises the essential parts, viz. a pinching and sighting device 2 and a cartridge 3. The cartridge is advantageously provided with a piece of body jewelry/ear jewelry 100 and a piercing means 101. It may further comprise a catching device 4 and a clip 5 containing a correctly oriented locking means 105 arranged therein. As an alternative to catching device and clip, the system can be provided with a locking means holder with a locking means arranged therein.

It will be appreciated that the arrangement of the different parts of the system relative to each other can take place in a number of different ways and that the invention should not be restricted to the embodiments described.

All parts of the system are advantageously intended to be disposable.

In the embodiment illustrated, the piercing means is shown in the form of a cannula which is arranged to the bar. It will be realised that it can also be loosely arranged relative to the front end of the bar. Moreover it will be appreciated that the piercing means may consist of a sharp tip which is arranged on the front end of the bar and adapted to be removed after piercing, or be integrated with the bar.

The cartridge has been described to comprise a piece of body jewelry or ear jewelry and an associated piercing means. It will be understood that the system may comprise two types of cartridge, a first type containing a piercing means and a second type containing a piece of body jewelry or ear jewelry, and that the operator changes cartridges during piercing.

It will be appreciated that the positions of the desired entry and exit holes can be oriented in various ways in the aiming means of the pinching and sighting device as long as the piercing means, when pressed through the cartridge, hits at least the desired entry hole.

The inventive system thus provides a number of advantages over prior art. The inventive system proposes an aseptic process since all the parts included in the system, including the piercing means and the piece of body jewelry or ear jewelry, can be provided and handled before, during and after the piercing operation in such a manner that the risk of infection and transfer of blood infection is minimal. The operator does not come into contact with the piercing means, the piece of body jewelry or ear jewelry and the locking means since these parts are handled in a wholly or partially closed system. In addition, the system is designed so that, in correct handling, the operator will not touch the parts of the system which come into contact with or close to the skin portion which is to be pierced or has been pierced. The system is also designed so that the operator should not come into contact with the skin portion in which piercing is to take place or has taken place, which also contributes to reducing the risk of infection and transfer of blood infection to a minimum. Each part of the system enables and simplifies an aseptic process in piercing.

The system further allows very high quality piercing since the cartridge is adapted to be fixed to the pinching and sighting device in such a manner that the piercing means automatically obtains a correct orientation relative to at least the desired position of the entry hole, or alternatively the desired positions of the entry and exit holes for piercing. Of cause, the latter is valid provided that the skin portion has been positioned and pinched in the pinching and sighting device in such a manner that the desired entry hole and exit hole are oriented opposite each other. By the cartridge being adapted to be arranged on the pinching and sighting device only after aligning the desired positions of the entry and exit holes, or at least the position of the desired entry hole, a distinct separation of the actual sighting step and the actual piercing step is obtained, thus making the entire piercing operation less dramatic and, consequently, reducing the risk of incorrect piercing to a minimum. This means that less operator experience than in traditional piercing is required.

The parts included in the system are also of a very simple design and can thus be provided at low cost and to be disposable.

A system for piercing and mounting of pieces of body jewelry or ear jewelry, and the parts included in the system, have been described above. Furthermore a method of preparation before piercing and insertion of a piece of body jewelry or ear jewelry has been described. It will be appreciated that the present invention is not restricted to the embodiments shown and that several modifications and variants are conceivable. Thus the invention is defined exclusively by the appended claims.

The invention claimed is:

1. A system (1) for piercing and positioning a piece of body jewelry or a piece of ear jewelry (100) in a skin portion, comprising:

a cartridge (3);

a pinching and sighting device (2) for piercing and positioning the piece of body jewelry or the piece of ear jewelry (100) in a skin portion, said pinching and sighting device comprising:

first and second gripping members (10*a*, 10*b*) which are adapted to grip a skin portion between them, the pinching and sighting device comprising at least one aiming member adapted to allow alignment of the pinching and sighting device relative to at least the position of a desired entry hole for piercing, and at least one of he gripping members (10*a*, 10*b*) comprises a first portion (12*a*) for locking the cartridge (3) with an outer surface of the pinching and sighting device, and for aligning said cartridge relative to said position of the desired entry hole; and the cartridge (3) having a mechanism (32) for aligning and connecting locking said cartridge with the outer surface of the pinching and sighting device (2) after the pinching and sighting device (2) grips said skin portion in a skin-gripping state, and a cavity of the cartridge, in which a pressing member (31), which is separable from said pinching and sighting device (2), is movable to press the piercing member (101) arranged in the cartridge and at least part of a bar (102) of a piece of body jewelry or ear jewelry arranged in the cartridge out of an opening (26) formed in the cartridge, wherein the cartridge is moveable from a first position remote from the pinching and sighting device to a second position in which the cartridge interlocks with said outer surface of the pinching and sighting device.

2. A system as claimed in claim 1, wherein said pressing member (31) is integrated in said cartridge.

3. A system as claimed in claim 1, wherein said pressing member (31) is arranged in a separate module (200).

4. A system as claimed in claim 1, the cartridge further comprising a first and a second half (20*a*, 20*b*), the halves between them define grooves (27, 28) for receiving and guiding said piercing member (101).

5. A system as claimed in claim 4, in which said grooves (27, 28) comprise a first groove (27) for receiving and guiding said piercing member (101) and a second groove (28) for receiving and guiding a locking member (103) integral with the piece of body jewelry or ear jewelry (100), the first and second grooves merging adjacent to said opening (26).

6. A system as claimed in claim 5, wherein said second groove (28) comprises a curvature arranged towards the first groove (27).

7. A system as claimed in claim 4, wherein the first and the second half (20*a*, 20*b*) are articulated to each other on the upper side of the cartridge.

8. A system as claimed in claim 4, wherein the first and the second half (20*a*, 20*b*) are interlockable to form a closed cartridge.

9. A system as claimed in claim 4, wherein the first and the second half (20, 20*b*) are interlockable by a locking device, said locking device comprising interposable fingers (24) which are arranged in the respective halves and which in their interposed state define a channel to allow insertion of a locking cotter pin (23).

10. A cartridge system as claimed in claim 1, wherein said pressing member (31) is adapted to perform a linear motion inside said cartridge.

11. A system as claimed in claim 1, wherein said mechanism (32) comprises at least one locking pin (33) which is operable about its own longitudinal axis, the locking pin being movable to a position in which the mechanism is in locking engagement with e the outer surface of said pinching and sighting device (2).

12. A system as claimed in claim 1, comprising a catching device (4) which is arranged opposite said opening, the catching device is integrated with the cartridge (3) or is arranged directly or indirectly with the cartridge.

13. A system as claimed in claim 12 wherein the catching device (4) is integrated with a locking member holder (60) integrated with the cartridge or is arranged directly or indirectly with the locking member holder.

14. A system as claimed in claim 1, comprising a locking member holder (60) which is arranged opposite said opening, the locking member holder is integrated with the cartridge or is arranged directly or indirectly with the cartridge.

15. A system as claimed in claim 1, wherein said first portion (12*a*) is complementary to the mechanism (32) arranged on the cartridge.

16. A system as claimed in claim 1, wherein at least one of said gripping members (10*a*, 10*b*) further comprises a second portion (12*b*) for direct or indirect arrangement of a catching device (4) to the pinching and sighting device.

17. A system as claimed in claim 1, comprising a catching device (4), the catching device is integrated with said pinching and sighting device.

18. A system as claimed in claim 1, comprising a locking member holder (60), the locking member holder is integrated with the pinching and sighting device (2) or is loosely arranged thereto.

19. A system as claimed in claim 18, further comprising a catching device (4), the catching device is integrated with the locking member holder (60) or is arranged directly or indirectly with the locking member holder.

20. A system as claimed in claim 1, further comprising a catching device (4) having a first portion (42*a*, 42*b*) for catching and retaining the piercing member (101), and a second portion (43) for arranging said catching device directly or indirectly to the pinching and sighting device (2) or the cartridge (3).

21. A system as claimed in claim 1, further comprising a clip (5) with a lock (105) arranged therewith, the lock is adapted to be arranged on a piece of body jewelry or ear jewelry (100) arranged in the skin portion.

22. A system as claimed in claim 1, further comprising a locking member holder.

23. A system as claimed in claim 1, further comprising an instrument for arranging said cartridge to said pinching and sighting device, the instrument also allows operation of a pressing member arranged with the cartridge.

24. A method of preparation before piercing and positioning a piece of body jewelry or a piece of ear jewelry (100) in a skin portion, comprising:

gripping with a pinching and sighting device (2) the skin portion intended for piercing in such a manner that desired positions of entry hole and exit hole are arranged opposite to each other and are both visible to a user, and after gripping, moving a cartridge (3) accommodating a piece of body jewelry or a piece of ear jewelry having a bar (102) and an associated piercing member (101), from a first position remote from the pinching and sighting device, to a second position adjacent the pinching and sighting device (2), and locking the cartridge (3) with an outer surface of said pinching and sighting device (2), the piercing member by the locking of the cartridge to the outer surface of the pinching and sighting device obtaining an alignment relative to at least said desired position of the entry hole.

25. A method as claimed in claim 24, wherein said arrangement locking and alignment of the cartridge are obtained by complementary gripping member portion and mechanism (12*a*, 32) arranged on the pinching and sighting device (2) and the cartridge (3) respectively.

26. A method as claimed in claim 24, further comprising arranging locking a catching device (4) directly or indirectly with the pinching and sighting device (2), the catching device is arranged opposite said cartridge (3).

* * * * *